US005679415A

United States Patent [19]

Weder

[11] Patent Number: 5,679,415

[45] **Date of Patent: *Oct. 21, 1997**

[54] RIBBON ASSEMBLY

[75] Inventor: Donald E. Weder, Highland, Ill.

[73] Assignee: Southpac Trust International, Inc.; not individually, but as Trustee of The Family Trust U/T/A dated Dec. 8, 1995, Charles A. Codding, Authorized Signatory for Southpac Trust International, Inc. trustee.

[ * ] Notice: The term of this patent shall not extend beyond the expiration date of Pat. No. 5,567,486.

[21] Appl. No.: 715,294

[22] Filed: Sep. 16, 1996

Related U.S. Application Data

[63] Continuation of Ser. No. 484,423, Jun. 7, 1995, Pat. No. 5,567,486, which is a continuation of Ser. No. 384,496, Feb. 6, 1995, Pat. No. 5,470,620, which is a continuation of Ser. No. 286,853, Aug. 5, 1994, Pat. No. 5,411,774, which is a continuation of Ser. No. 101,210, Aug. 3, 1993, Pat. No. 5,387,446.

[51] Int. Cl.[6] ..... B32B 9/00

[52] U.S. Cl. ..... 428/4; 428/4; 428/5; 428/24; 428/26; 428/36.92; 428/101; 428/114; 428/198; 223/46; 156/70

[58] Field of Search ..... 428/4, 5, 24, 26, 428/101, 906, 36.92, 114, 198, 192, 286, 284; 156/70; 223/46; 41/10

[56] References Cited

U.S. PATENT DOCUMENTS

| | | | |
|---|---|---|---|
| Re. 23,835 | 6/1954 | McMahon . | |
| 2,626,883 | 1/1953 | Boese . | |
| 2,681,525 | 6/1954 | James . | |
| 2,738,298 | 3/1956 | David et al. . | |
| 2,763,080 | 9/1956 | Welch . | |
| 2,774,164 | 12/1956 | James . | |
| 2,841,905 | 7/1958 | Wanchek . | |
| 2,849,821 | 9/1958 | Doig . | |
| 2,869,264 | 1/1959 | Salmi . | |
| 2,872,086 | 2/1959 | Duncan . | |
| 2,933,223 | 4/1960 | Kravig et al. . | |
| 3,001,359 | 9/1961 | Simon . | |
| 3,030,719 | 4/1962 | Enomoto . | |
| 3,041,765 | 7/1962 | Paar . | |
| 3,112,240 | 11/1963 | Kravig et al. . | |
| 3,353,346 | 11/1967 | Laureti . | |
| 3,539,431 | 11/1970 | Schmidt et al. . | |
| 3,560,313 | 2/1971 | Herkimer . | |
| 3,632,464 | 1/1972 | Grikis . | |
| 3,637,455 | 1/1972 | Pearson et al. . | |
| 3,641,760 | 2/1972 | Keuchel . | |
| 3,676,277 | 7/1972 | Truskolaski . | |
| 3,774,387 | 11/1973 | Woodell . | |
| 3,790,041 | 2/1974 | Pearson et al. . | |
| 3,884,030 | 5/1975 | Baxter et al. . | |
| 3,954,212 | 5/1976 | Bolis | 223/46 |
| 4,231,837 | 11/1980 | Ramey et al. . | |
| 4,329,382 | 5/1982 | Truskolaski et al. | 428/4 |
| 4,405,676 | 9/1983 | Pohl . | |
| 4,449,652 | 5/1984 | Coppins et al. . | |
| 4,476,168 | 10/1984 | Aoyama . | |
| 4,515,837 | 5/1985 | Cheng . | |
| 4,585,676 | 4/1986 | DeSmet et al. | 428/5 |
| 4,608,283 | 8/1986 | White . | |
| 4,634,612 | 1/1987 | Nelson et al. | 428/4 |
| 4,656,064 | 4/1987 | Cheng . | |
| 4,684,552 | 8/1987 | LaBrosse et al. . | |
| 4,697,407 | 10/1987 | Wasserman . | |
| 4,713,267 | 12/1987 | Truskolaski . | |
| 4,724,175 | 2/1988 | LaBrosse et al. | 428/4 |
| 4,725,461 | 2/1988 | Masui . | |
| 4,777,066 | 10/1988 | White et al. | 428/4 |
| 4,806,404 | 2/1989 | Cascino . | |
| 4,812,338 | 3/1989 | Masui | 428/4 |
| 4,822,648 | 4/1989 | Cheng | 428/4 |
| 4,840,822 | 6/1989 | Cheng . | |
| 5,004,642 | 4/1991 | Youngs . | |

*Primary Examiner*—Patrick Ryan
*Assistant Examiner*—Abraham Bahta
*Attorney, Agent, or Firm*—Dunlap & Codding, P.C.

[57] ABSTRACT

The present invention discloses a ribbon assembly having a decorative ribbon formed on a support member wherein an elastic member having a stretched condition and an unstretched condition extends between a piece of material and the support member for substantially automatically forming the decorative ribbon.

7 Claims, 2 Drawing Sheets

RIBBON ASSEMBLY

CROSS-REFERENCE TO RELATED APPLICATIONS

This application is a continuation of application U.S. Ser. No. 08/484,423, filed Jun. 7, 1995, now U.S. Pat. No. 5,567,486, entitled RIBBON ASSEMBLY which is a continuation of application Ser. No. 08/384,496, filed Feb. 6, 1995, now U.S. Pat. No. 5,470,620 entitled "RIBBON ASSEMBLY FORMING CURVED SEGMENTS FOR MAKING A BOW OR RUFFLE", which is a continuation of U.S. Ser. No. 08/286,853, filed Aug. 5, 1994, entitled "RIBBON ASSEMBLY FORMING CURVED SEGMENTS FOR MAKING A BOW OR RUFFLE, now U.S. Pat. No. 5,411,774, issued May 2, 1995; which is a continuation of U.S. Ser. No. 08/101,210, filed Aug. 3, 1993, entitled "RIBBON ASSEMBLY FORMING CURVED SEGMENTS FOR MAKING A BOW OR RUFFLE", now U.S. Pat. No. 5,387,446, issued Feb. 7, 1995.

FIELD OF THE INVENTION

The present invention relates generally to ribbon assemblies for making decorative ribbons, and more particularly, but not by way of limitation, to a ribbon assembly having a decorative ribbon formed on a support member wherein an elastic member extends between a piece of material and the support member for substantially automatically forming the decorative ribbon.

DESCRIPTION OF PREFERRED EMBODIMENTS

Figure 1:
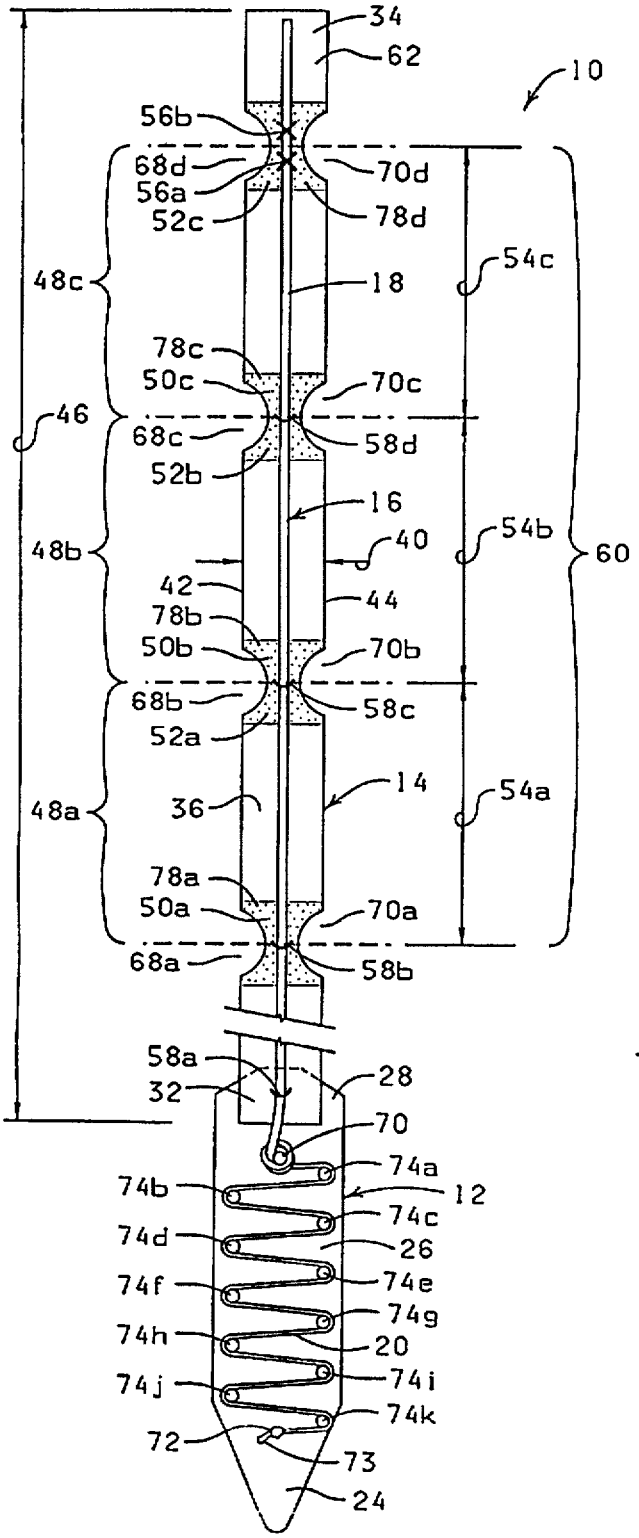
FIG. 1 is a plan view showing a ribbon assembly constructed in accordance with the present invention wherein a strip of material is connected to a ribbon support member and a elastic member extends between the strip of material and the support member, the elastic member being in an unstretched condition on the strip of material and a stretched condition on the ribbon support member.
Figure 3:
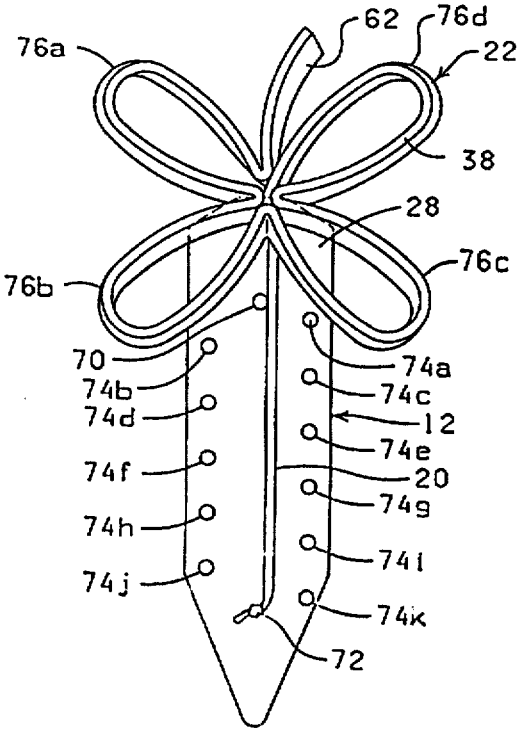
FIG. 3 is a pictorial representation of the ribbon assembly of FIG. 1 wherein a portion of the elastic member disposed along the ribbon support member has been released towards an unstretched condition so as to place a portion of the elastic member disposed along the strip of material in a stretched condition so as to form a decorative bow from the strip of material.

Shown in FIG. 1 is a ribbon assembly 10 constructed in accordance with the present invention. The ribbon assembly 10 includes a ribbon support member 12 (also referred to herein as support member 12), a piece or strip of material 14 and an elastic member 16 extending along the support member 12 and the strip of material 14 substantially as shown. As will be more fully described in detail hereinafter, a first portion 18 of the elastic member 16 disposed along the strip of material 14 is maintained in an unstretched condition (FIG. 1); and a second portion 20 of the elastomeric member 16 disposed on the support member 12 has a stretched condition (FIG. 1) which is moveable towards an unstretched condition (FIG. 3) whereby the second portion 20 of the elastic member 16 pulls the first portion 18 of the elastic member 16 to form a decorative ribbon 22. That is, the second portion 20 of the elastic member 16 disposed on the support member 12 is sufficiently stretched under tension so that when the second portion 20 of the elastic member 16 is moved towards an unstretched condition the elastic member 16 remains under sufficient tension (i.e., is sufficiently stretched) so as to move or draw the first portion 18 of the elastic member 16 disposed along the strip of material 14 towards the support member 12 and thereby form the decorative ribbon 22 from the strip of material 14 substantially as shown in FIG. 3.

The term decorative ribbon as used herein is to be understood to mean a bow or ruffle-like structure, or any type of gathering of the strip of material 14 to provide an ornamental configuration formed from a piece or the strip of material 14.

The strip of material 14 may be constructed of any material commonly used in the art for making ribbons, such as plastic film or cloth (natural or synthetic or combinations thereof) or any other material which can be moved from a flat condition to a condition having curved segments in the manner to be described in greater detail below.

The support member 12 is a substantially rigid member having a first end 24, a medial portion 26 and a second end 28; and the strip of material 14 has a first end 32, a second end 34, an upper surface 36 (FIG. 3), a lower surface 38 and a strip width 40 extending between a first strip side 42 and a second strip side 44. The first end 32 of the strip of material 14 is connected to the second end 28 of the support member 12 by any suitable means known in the art, such as with an adhesive, staples, brads and the like.

The strip of material 14 has a strip length 46 (FIG. 1) extending between the first end 32 and the second end 34. The strip of material 14 is divided into a plurality of strip segments 48 (three strip segments 48 being shown in FIG. 1 and designated therein by the individual reference numerals 48*a*, 48*b*, and 48*c*). Each of the strip segments 48 has a first segment end 50 (the individual first segment ends 50 being shown in FIG. 1 and designated therein by the individual reference numerals 50*a*, 50*b*, and 50*c*). Each of the strip segments 48 also has a second segment end 52 (the individual second segment ends 52 being designated in FIG. 1 by the individual reference numerals 52*a*, 52*b*, and 52*c*). Each of the strip segments 48 has a segment length 54 extending between the respective first segment end 50 and the respective second segment end 52. (The individual segment lengths 54 are shown in FIG. 1 and designated therein by the individual reference numerals 54*a*, 54*b*, and 54*c*.)

In the embodiment shown in FIG. 1, the segment lengths 54 are substantially equal. In some embodiments, the segment lengths 54 may be varied or different to provide different effects (i.e., appearance in the resulting decorative ribbon 22 of FIG. 3).

As shown in FIG. 1, the second segment end 52 of each of the strip segments 48 is disposed adjacent the first segment end 50 of the adjacent strip segment 48. The strip segments 48 are spaced along the strip length 46 between the first strip end 32 and the second strip end 34.

The first portion 18 of the elastic member 16 is disposed on the lower surface 36 of the strip of material 14 and extends from the second end 34 of the strip of material 14 to the second end 28 of the support member 12. The second portion 20 of the elastic member 16 is disposed on the support member 12 and extends from the second end 28 of the support member 12 to the first end 24 thereof. The elastic member 16 thus extends between the second end 34 of the strip of material 14 and the first end 24 of the support member 12.

Figure 2:
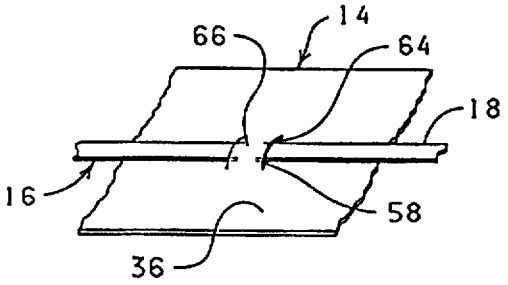
FIG. 2 is a plan view of a segment of the strip of material of FIG. 1 showing a typical loose connection point for connecting the elastic member to the strip of material.

The elastic member 16 is securely connected to the strip of material 14 near the second end 34 thereof at secure connection points 56 (the individual secure connection points 56 being designated in FIG. 1 by the individual reference numerals 56*a* and 56*b*). The first portion 18 of the elastic member 16 is loosely or slidably connected to the strip of material 14 at loose connection points 58 (FIG. 2), the individual loose connection points 58 being designated in FIG. 1 by the individual reference numerals 58*a*, 58*b*, 58*c* and 58*d*.

A plurality of the strip segments 48 define a bow segment 60 (FIG. 1) having a bow end 62 (FIG. 3). As previously stated, the elastic member 16 is securely connected to the strip of material 14 by the secure connection points 56*a* and 56*b* at the bow end 62 and to the support member 12 as will be discussed in more detail hereinafter to stabilize the elastic member 16 on the support member 12, and the elastic member 16 is loosely connected to the strip of material 14 at the loose connection points 58*a*, 58*b*, 58*c* and 58*d*.

The elastic member 16 may be connected to the strip of material 14 by way of secure connection points 56*a* and 56*b* by adhesively connecting the elastic member 16 to the strip of material 14 or the elastic member 16 may be stitched to the strip of material 14 at the secure connection points 56*a* and 56*b*.

The elastic member 16 may be connected to the strip of material 14 via the loose connection points 58 by a loop (not shown) of stitching material or thread extended through the strip of material 14 and looped over the elastic member 16 or the loose connection points 58 may be formed by cutting slits 64 and 66 (FIG. 2) in the strip of material 14 and extending the elastic member 16 through the slit 64 and under strip of material 14 and back through the slit 66 with the elastic member 16 being slidably disposed in the slits 64 and 66. In the alternative, the loose connection pints 58 may be formed by securing a length of material at its opposite ends to the strip of material 14 so as to form a loop through which the elastic member 16 may be extended.

A plurality of spaced apart recesses or cut outs 68 (FIG. 1) are formed through the first strip side 42 with each of the recesses 68 being positioned between two adjacent strip segments 48. The individual recesses 68 are designated in FIG. 1 by the specific reference numerals 68*a*, 68*b*, 68*c* and 68*d*.

A plurality of recesses or cut outs 70 (FIG. 1) are formed through the second strip side 44 with each of the recesses 70 being positioned between two adjacent strip segments 48 and each of the recesses 70 being generally aligned with one of the recesses 68. The individual recesses 70 are shown in FIG. 1 and designated by the individual reference numerals 70*a*, 70*b*, 70*c* and 70*d*.

To maintain the first portion 18 of the elastic member 16 extending along the strip of material 18 in an unstretched condition, while maintaining the second portion 20 of the elastic member extending along the support member 12 in a stretched condition such that the second portion 20 of the elastic member 12 can be selectively released to move towards the unstretched condition whereby the second portion 20 of the elastic member 16 extending along the support member 12 cooperates with the first portion 18 of the elastic member 16 extending the strip of material 14 to form the decorative ribbon 22 (FIG. 3) supported on the support member 12, the ribbon assembly 10 further includes a first post member 70 disposed on the support member 12 near the second end 28 thereof, a connector member-72 for connecting one end 73 of the elastic member 16 to the support member 24 near the first end 24 thereof (substantially as shown in FIGS. 1 and 3) and a plurality of second or retaining post members 74, each of the post members being designated in FIGS. 1 and 3 by the specific reference numerals 74*a*, 74*b*, 74*c*, 74*d*, 74*e*, 74*f*, 74*g*, 74*h*, 74*i*, 74*j*, and 74*k*. To maintain the first portion 18 of the elastic member 16 extending along the strip of material 14 in the unstretched condition (FIG. 1) while maintaining the second portion 20 of the elastic member 16 in a stretched condition, the elastic member 16 is wrapped about the post member 70 so as to temporarily secure same to the post member 70 and thereafter the second portion 20 of the elastic member 16 is disposed around the retaining post members 74*a*–74*k* in a serpentine manner so that the second portion 20 of the elastic member 16 is maintained in a stretched condition. It should be noted that the amount of stretching of the second portion 20 of the elastic member 16 should be sufficient so that when the second portion 20 of the elastic member 16 is released and allowed to move towards the unstretched condition, sufficient tension remains on the elastic member 16 to place the first portion 18 of the elastic member 16 extending along the strip of material 14 in a stretched condition which, as it moves towards an unstretched condition, results in the formation of the decorative ribbon 22 as shown in FIG. 3.

To form the decorative ribbon 22 supported on the support member 12 (FIG. 3) the elastic member 16 is disengaged from the first post member 70 and from disengagement with the retaining post members 74*a*–74*k* substantially as shown in FIG. 3 whereupon sufficient stretching is imparted to the first portion 18 of the elastic member 16 disposed along the strip of material 14 to substantially automatically form the decorative ribbon 22. It should be noted that additional stretching can be imparted to the second portion 18 of the elastic member 16, if desired, by securing at least a portion of the second portion 20 of the elastic member 16 about one or more of the retaining posts 74. In such occurrence, the first post member 70 functions as an alignment guide to maintain the proper disposition of the decorative ribbon 22 relative to the support member 12.

As previously described, the first portion 18 of elastic member 16 is secured between the strip segments 48 forming the bow segment 60 at the loose connection points 58*b*, 58*c* and 58*d*. When the second portion 20 of the elastic member 16 is released as previously described, the first portion 18 of the elastic member 16 disposed along the strip of material 14 is automatically placed in a stretched condition whereupon it contracts, or moves towards an unstretched condition, so that the elastic member 16 slidingly moves through the loose connection points 58*a*, 58*b*, 58*c* and 58*d* as the first portion 18 of the elastic member 16 contracts or moves towards the unstretched condition.

As the elastic member 16 moves toward the unstretched condition, the first segment end 52 of each of the strip segments 48 is moved towards the second segment end 54 of the respective strip segments 48 to form a curved segment 76 with the individual curved segments 76 being shown in FIG. 3 and designated by the individual reference numerals 76*a*, 76*b*, 76*c* and 76*d*. Each of the strip segments 48 form one of the curved segments 76 of the decorative ribbon 22 when the second portion 20 of the elastic member 16 is moved from the stretched condition towards the unstretched condition which, in turn, positions the first portion 18 of the elastic member 16 in a stretched condition which tends to move towards the unstretched condition to produce the decorative ribbon 22.

When the second portion 20 of the elastic member 16 is released, the decorative ribbon 22 (FIG. 2) automatically is formed and the resulting ribbon assembly 10 can be applied to a package or a plant pot or other object to provide a decorative ribbon ornamentation therefore. In addition, the curved segments 76 may be tied with an additional strip of material (not shown) wrapped about the recesses 68 and 70 and the curved segments 76 could then be moved or manipulated in a conventional way to form a more decorative bow or a bow of a different shape.

The strip of material 14 may also include adhesive 78 disposed on the lower surface 36 of the strip of material 14. More particularly, the adhesive 78 is applied to the lower surface 36 of the strip of material 14 at a plurality of spaced apart positions generally about the segment ends 50 and 52. The individual adhesive portions 78 being designated in FIG. 1 by the respective reference numerals 78*a*, 78*b*, 78*c* and 78*d*.

When the strip of material 14 is formed into the decorative ribbon 22 in the manner described before, the adhesive 78 cooperates to connect the first segment end 50 to the second segment end 52 of each of the strip segments 48 and thereby cooperates to secure the strip of material 14 in the form of the curved segments 76 forming the decorative ribbon 22 substantially as shown in FIG. 3.

Figure 4:
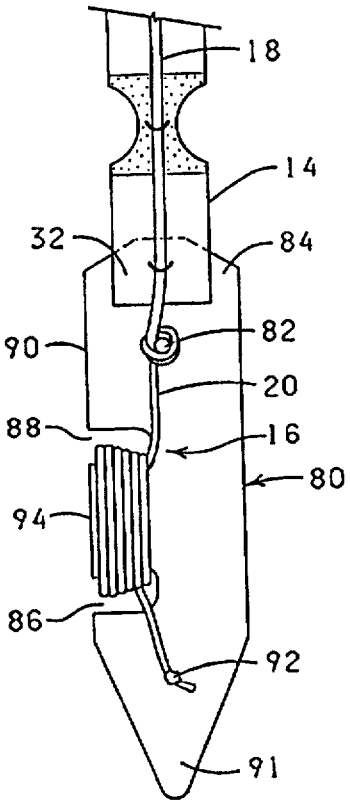
FIG. 4 is another embodiment of a ribbon support member of the ribbon assembly of the present invention.

Shown in FIG. 4 is a modified ribbon support member 80 having the second portion 20 of the elastic member 16 supported thereon in a stretched condition. The support member 80 includes a post member 82 disposed on the support member 80 near a second end 84 thereof and a pair of spatially disposed recesses 86 and 88 formed in one side 90 of the support member 80 substantially as shown. The second end 84 of the support member 80 is connected to the first end 32 of the strip of material 14 and the elastic member 16 is connected to the support member 80 near a first end 91 thereof via a connector 92.

In order to place the second portion 20 of the elastic member 16 in a stretched condition, while maintaining the first portion 18 of the elastic member 16 extending along the strip of material 14 in the manner heretofore described, the elastic member 16 is wrapped about the post member 82 and then wrapped about a support segment 94 formed between the recesses 86 and 88 substantially as shown. As previously described, the second portion 20 of the elastic member 16 is placed under sufficient tension, i.e., stretched sufficiently, so that the second portion 20 of the elastic member 16, upon movement towards the unstretched condition, places the first portion 18 of the elastic member 16 extending along the strip of material 14 in a stretched condition whereby it tends to move also to the unstretched condition to form the decorative ribbon 22 (FIG. 3) having a plurality of bow segments.

Figure 5:
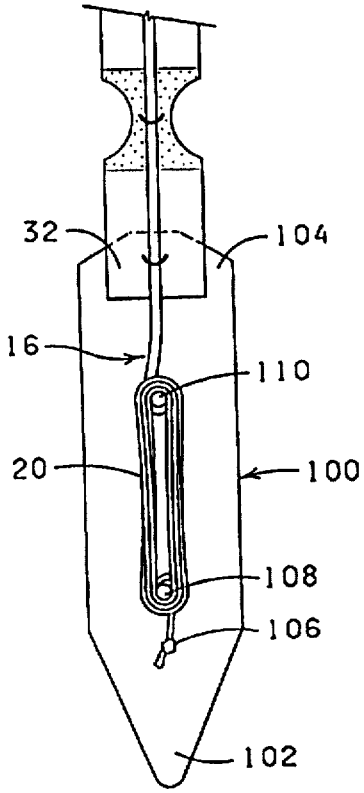
FIG. 5 is a plan view of another embodiment of a ribbon support member of the ribbon assembly of the present invention.

Shown in FIG. 5 is another embodiment of a support member 100. The support member 100 is provided with a first end 102 and a second end 104. The second end 104 of the support member 100 is connected to the first end 32 of the strip of material 14.

In order to connect the second portion 20 of the elastic member 16 to the support member 100 so that the first portion 18 disposed along the strip of material 14 can be maintained in an unstretched condition and the second portion 20 of the elastic member 16 disposed along the support member 100 can be maintained in a stretched condition for the purposes heretofore described, the elastic member 16 is connected to the support member 100 near the first end 102 thereof via a connector member 106 and the second portion 20 of the elastic member 16 is wrapped about the spatially disposed post members 108 and 110 substantially as shown. By connecting the elastic member 16 to the support member 100 via the connector member 106 and wrapping the elastic member 16 initially about the post member 102 to secure same thereto and thereafter wrapping the elastic member 16 around the post members 108 and 110 a sufficient number of times to place the second portion 20 of the elastic member 16 in a stretched condition, one can readily maintain the first portion 18 of the elastic member 16 disposed along the strip of material 14 in an unstretched condition while the second portion 20 of the elastic member 16 disposed on the support member 100 is maintained in a stretched condition as heretofore described.

Figure 6:
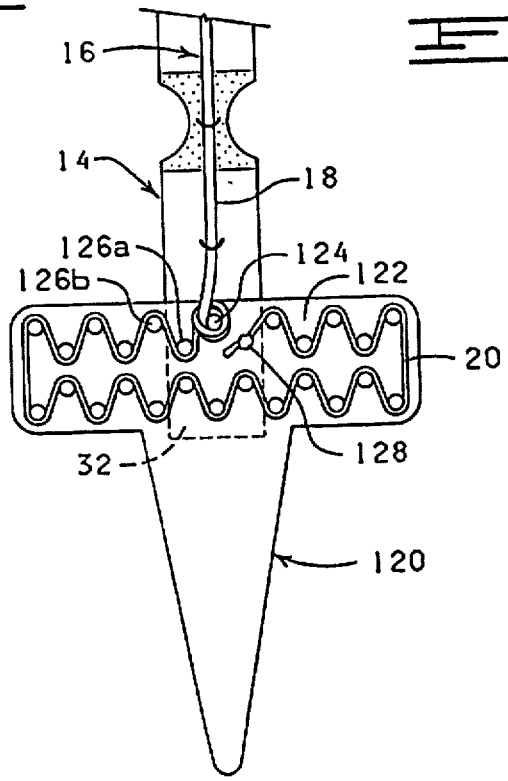
FIG. 6 is yet another embodiment of a ribbon support member of the ribbon assembly constructed in accordance with the present invention.

Shown in FIG. 6 is a substantially T-shaped support member 120 which can be employed in the formation of decorative ribbons in accordance with the present invention. The first end 32 of the strip of material 14 is connected to an upper end 122 of the support member 120. The support member 120 is provided with a first post member 124 for temporarily connecting the elastic member 16 to the support member 120 and thereby temporarily divide the first portion 18 of the elastic member 16, which is maintained in an unstretched condition, from the second portion 20 of the elastic member 16 which is maintained in a stretched condition as heretofore described. The support member 120 further includes a plurality of second or retaining post members 126, only two of which are designated in FIG. 6 by the numerals 126*a* and 126*b*. The elastic member 16 is connected to the support member 120 near the upper end 122 of the support member 120 via a connector member 128 substantially as shown. Thus, in order to maintain the first portion 18 of the elastic member 16 extending along the strip of material 14 in a non-stretched condition, while maintaining the second portion 20 of the elastic member 16 disposed along the support member 120 in a stretched condition so that upon release of same a decorative ribbon can be made from the strip of material 14 and the elastic member 16 as heretofore described, the elastic member 16 is securely wrapped about the post member 124 a sufficient number of times to prevent the tension placed on the second portion 20 of the elastic member 16 from affecting the unstretched condition of the first portion 18 of the elastic member 16 disposed along the strip of material 14 until such time as the second portion 20 of the elastic member 16 is selectively released so the elastic member 16 is moved towards an unstretched condition as heretofore described.

While the decorative ribbon 22 (FIG. 3), has been described as being formed from the strip of material 14, it is to be understood that the present invention is not limited to any particular configuration of the piece of material connected to the support member. That is, the piece of material employed in the construction of a decorative ribbon in accordance with the present invention can have any geometrical configuration and the appearance or shape of the resulting decorative ribbon will be dependent on the shape and geometric configuration of the piece of material and the configuration or pattern of the elastic member connected to the piece of material.

Changes may be made in the construction and the operation of the various components, elements and assemblies described herein or in the steps or the sequence of steps of the methods described herein without departing from the spirit and scope of the invention as defined in the following claims.

What is claimed:

1. A ribbon assembly, comprising:

a strip of material having a first end, a second end, an upper surface and a lower surface;

an elastic member having a first portion, a second portion, a stretched condition and an unstretched condition, the first portion of the elastic member connected to the second end of the strip of material and the first portion of the elastic member slidably connected to the strip of material by a plurality of loose connections points such that the first portion of the elastic member extends along one of the upper and lower surfaces of the strip of material in a substantially unstretched condition; and accumulating means for accumulating and maintaining the second portion of the elastic member in a stretched condition and for permitting the second portion of the elastic member to be selectively released to move the second portion of the elastic member towards an unstretched condition whereby the second portion of the elastic member cooperates with the first portion of the elastic member extending along the piece of material to form a decorative ribbon.

2. The ribbon assembly of claim 1 further comprising:

adhesive or cohesive means disposed on at least a portion of the strip of material for adhesively connecting portions of the strip of material when same is formed into a decorative ribbon by selectively releasing the second portion of the elastic member so as to permit the elastic member to move from a stretched condition towards an unstretched condition.

3. A ribbon assembly, comprising:

a strip of material having a first end, a second end, an upper surface, a lower surface and a strip width extending between a first strip side and a second strip side, the strip of material being divided into a plurality of strip segments with each strip segment having a first segment end and a second segment end with the second segment end of each strip of material being disposed substantially adjacent the first segment end of the adjacent strip segment;

an elastic member having a first portion, a second portion, a stretched condition and an unstretched condition, the first portion of the elastic member connected to the strip of material near the second end thereof and the first portion of the elastic member slidably connected to the strip of material by a plurality of loose connections points disposed between each of the segments of the strip of material such that the first portion of the elastic member extends along one of the upper and lower surfaces of the strip of material in a substantially unstretched condition and accumulating means for accumulating and maintaining the second portion of the elastic member in a stretched condition and for permitting the second portion of the elastic member to be selectively released to the unstretched condition whereby the second portion of the elastic member cooperates with the first portion of the elastic member to form a decorative ribbon.

4. The ribbon assembly of claim 3 wherein the strip of material is defined further to include a plurality of recess means formed in the first strip side and the second strip side of the strip of material for cooperating to form the strip of material into a decorative ribbon.

5. The ribbon assembly of claim 4 further comprising:

adhesive or cohesive means disposed on the strip of material for connecting the first segment end to the second segment end of each segment when the second portion of the elastic member is selectively released to the unstretched condition for adhesively or cohesively securing each segment in a curved segment form.

6. The ribbon assembly of claim 3 wherein the strip of material is defined further to include a plurality of recess means formed in the first strip side and the second strip side of the strip of material for cooperating to form the strip of material into a decorative ribbon when the second portion of the elastic member is selectively released from the accumulating means.

7. The ribbon assembly of claim 6 further comprising:

adhesive or cohesive means disposed on the strip of material for connecting the first segment end to the second segment end of each segment when the second portion of the elastic member is selectively released from the accumulating means and the second portion of the elastic memeber is moved toward the unstretched condition and for adhesively or cohesively securing each segment in a curved segment form.

* * * * *